US012559909B2

(12) United States Patent
Yamada et al.

(10) Patent No.: US 12,559,909 B2
(45) Date of Patent: Feb. 24, 2026

(54) CONSTRUCTION ASSISTANCE SYSTEM

(71) Applicant: Hitachi Construction Machinery Co., Ltd., Tokyo (JP)

(72) Inventors: Hiroyuki Yamada, Tokyo (JP); Akira Kanazawa, Tokyo (JP); Shinya Imura, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 314 days.

(21) Appl. No.: 18/023,193

(22) PCT Filed: Oct. 28, 2021

(86) PCT No.: PCT/JP2021/039810
§ 371 (c)(1),
(2) Date: Feb. 24, 2023

(87) PCT Pub. No.: WO2022/097563
PCT Pub. Date: May 12, 2022

(65) Prior Publication Data

US 2023/0295899 A1 Sep. 21, 2023

(30) Foreign Application Priority Data

Nov. 6, 2020 (JP) ..... 2020-185484

(51) Int. Cl.
*E02F 9/20* (2006.01)
*E02F 9/24* (2006.01)
*E02F 9/26* (2006.01)

(52) U.S. Cl.
CPC ..... *E02F 9/205* (2013.01); *E02F 9/24* (2013.01); *E02F 9/261* (2013.01)

(58) Field of Classification Search
CPC ..... E02F 9/205; E02F 9/24; E02F 9/261
(Continued)

(56) References Cited

U.S. PATENT DOCUMENTS 11,748,836 B2 * 9/2023 Tamazato ..... G06F 3/14 705/7.28
2019/0164402 A1 * 5/2019 Lin ..... G06Q 10/1091
(Continued)

FOREIGN PATENT DOCUMENTS

CN 108269026 A 7/2018
EP 2 578 757 B1 5/2019
(Continued)

OTHER PUBLICATIONS

International Search Report (PCT/ISA/210) issued in PCT Application No. PCT/JP2021/039810 dated Jan. 18, 2022 with English translation (five (5) pages).
(Continued)

*Primary Examiner* — Adam D Tissot
(74) *Attorney, Agent, or Firm* — Crowell & Moring LLP

(57) ABSTRACT

The object of the present invention is to provide a constriction assistance system that can optimize the safety and the productivity in a work at a construction site. Accordingly, the construction assistance system that has a safety construction assistance function that contributes to risk reduction in regard to a worker and a work machine at a construction site includes a server that collects operation information on the work machine deployed at the construction site, and a communication network that connects the work machine with the server. The server measures an actuation count of the safety construction assistance function, calculates a safety awareness level of the worker who works at the construction site on the basis of the actuation count, and delivers the safety awareness level to a receiving device.

5 Claims, 7 Drawing Sheets

(58) Field of Classification Search
USPC ..... 701/2
See application file for complete search history.

(56) References Cited

U.S. PATENT DOCUMENTS

| | | | | |
|---|---|---|---|---|
| 2021/0246626 | A1* | 8/2021 | Yamamoto | G08B 21/24 |
| 2022/0051150 | A1* | 2/2022 | Watanabe | G06Q 10/0631 |
| 2023/0392351 | A1 | 12/2023 | Matsui et al. | |

FOREIGN PATENT DOCUMENTS

| | | | | |
|---|---|---|---|---|
| JP | 2008-291519 | A | 12/2008 | |
| JP | 2019-7348 | A | 1/2019 | |
| JP | 2019-67217 | A | 4/2019 | |
| JP | 2019-102044 | A | 6/2019 | |
| JP | 2020-145526 | A | 9/2020 | |
| JP | 2020-166540 | A | 10/2020 | |
| KR | 10-2016-0127881 | A | 11/2016 | |
| KR | 20160127881 | A * | 11/2016 | G06Q 50/10 |
| WO | WO 2020/095945 | A1 | 5/2020 | |
| WO | WO 2022/091838 | A1 | 5/2022 | |

OTHER PUBLICATIONS

Japanese-language Written Opinion (PCT/ISA/237) issued in PCT Application No. PCT/JP2021/039810 dated Jan. 18, 2022 (four (4) pages).

Extended European Search Report issued in European Application No. 21889116.6 dated Jul. 22, 2024 (12 pages).

International Preliminary Report on Patentability (PCT/IB/338 & PCT/IB/373) issued in PCT Application No. PCT/JP2021/039810 dated May 19, 2023, including English translation of document C2 (Japanese-language Written Opinion (PCT/ISA/237), filed on Feb. 24, 2023) (6 pages).

Chinese-language Office Action issued in Chinese Application No. 202180051824.X dated May 1, 2025 with partial English translation (22 pages).

Korean-language Office Action issued in Korean Application No. 10-2023-7006108 dated Sep. 4, 2025, with English translation (12 pages).

* cited by examiner

FIG. 4

| | SAFETY CONSTRUCTION ASSISTANCE FUNCTION ACTUATION COUNT | | | |
|---|---|---|---|---|
| | FUNCTION A | FUNCTION B | FUNCTION C | FUNCTION D |
| WORKER A | 0 | 0 | 1 | 0 |
| WORKER B | 2 | 1 | 0 | 0 |
| WORKER C | 0 | 5 | 0 | 2 |
| WORKER D | 3 | 1 | 6 | 11 |

FIG. 6

| | SAFETY AWARENESS LEVEL | | | |
|---|---|---|---|---|
| | FIRST WEEK OF MMMM | SECOND WEEK OF MMMM | THIRD WEEK OF MMMM | FOURTH WEEK OF MMMM |
| WORKER A | 0.81 | 0.82 | 0.79 | 0.85 |
| WORKER B | 0.65 | 0.71 | 0.71 | 0.73 |
| WORKER C | 0.50 | 0.43 | 0.48 | 0.45 |
| WORKER D | 0.31 | 0.54 | 0.68 | 0.70 |

Report

| | SAFETY AWARENESS LEVEL | | | |
|---|---|---|---|---|
| | FIRST WEEK OF MMMM | SECOND WEEK OF MMMM | THIRD WEEK OF MMMM | FOURTH WEEK OF MMMM |
| WORKER A | 0.81 | 0.82 | 0.79 | 0.85 |
| WORKER B | 0.65 | 0.71 | 0.71 | 0.73 |
| WORKER C | 0.50 | 0.43 | 0.48 | 0.45 |
| WORKER D | 0.31 | 0.54 | 0.68 | 0.70 |
| AVERAGE | 0.57 | 0.63 | 0.67 | 0.68 |

CONSTRUCTION ASSISTANCE SYSTEM

TECHNICAL FIELD

The present invention relates to a construction assistance system that assists construction by a work machine or the like.

BACKGROUND ART

To a worker who performs a work around a work machine such as a construction machine or a mobile crane, there is such a risk that the worker is caught by or entangled in the work machine. Therefore, although the risk of the worker can be reduced if the worker performs a work at a distance from the work machine, it is also supposed that the worker comes close to the work machine for such a purpose as to assist the work by the work machine. Generally, the safety and the productivity have a relation of an inverse proportion to each other, and if the worker is spaced from the work machine in order to enhance the safety, then the productivity decreases, but if the worker comes close to the work machine in order to enhance the productivity, then the safety decreases.

Patent Document 1 provides an excavator that can ensure the safety of a worker therearound. The excavator includes human sensing means for sensing a human within a predetermined range around the excavator, and a controller that determines for every predetermined control cycle whether or not a human is sensed by the human sensing means before a hydraulic actuator is rendered operative and that inhibits one of a swing action, a travel action and an excavation action, when a human is sensed. Consequently, if the excavator senses a worker around the excavator, then the excavator inhibits its action to ensure the safety of the worker. In this manner, there is an initiative for decreasing the risk of an accident by using such a function (safety construction assistance function) for assisting safety construction as to sense a worker and inhibit an action of the excavator or to encourage a worker to behave more safely.

PRIOR ART DOCUMENT

Patent Document

Patent Document 1: JP-2019-7348-A

SUMMARY OF THE INVENTION

Problem to be Solved by the Invention

The excavator of Patent Document 1 ensures the safety of a worker around the excavator by stopping the machine. However, this function performs the same response basically to all workers and behaves in a similar manner not only for a worker who performs a work paying appropriate attention to the safely but also for a worker who shows a lack of thought regarding the safety. In this case, it cannot help but employ a conservatively design for the safety construction assistance function such that the risk of an accident decreases also for a worker who shows a lack of thought regarding the safety. Consequently, excessive safety construction assistance (assistance to decreasing in the risk of an accident by the safety construction assistance function) may be provided to a worker who performs a work paying appropriate attention to the safely. Such excessive safety construction assistance sometimes limits an action of the work machine more than necessary, and there is the possibility that the productivity may decrease.

The present invention has been made in view of the subject described above, and the object of the present invention is to provide a constriction assistance system that can optimize the safety and the productivity in a work at a construction site.

Means for Solving the Problem

In order to achieve the object described above, according to the present invention, there is provided a construction assistance system that has a safety construction assistance function that contributes to risk reduction in regard to a worker and a work machine at a construction site, including a server that collects operation information on the work machine deployed at the construction site, a communication network that connects the work machine with the server, and a receiving device capable of receiving information delivered from the server, in which the server is configured to measure an actuation count of the safety construction assistance function, calculate a safety awareness level of a worker who works at the construction site on a basis of the actuation count, and deliver the safety awareness level to the receiving device.

According to the present invention configured in such a manner as described above, it is possible to grasp to which degree the worker at the construction site cares about the safety (safety awareness level) during work, and by changing the control parameters for the safety construction assistance function according to the safety awareness level of the worker who is the target of the actuation of the safety construction assistance function, excessive safety construction assistance can be prevented from being carried out, and the productivity of the work can be improved. Further, by presenting the safety awareness level regarding the safety of the worker to the supervisor of the construction site, it is also possible to carry out awareness building of a worker who is low in safety awareness level (showing relatively a lack of thought regarding the safety) by presenting the safety awareness level of the worker to the supervisor of the construction site.

Advantages of the Invention

With the construction assistance system according to the present invention, the safety and the productivity in a work at a construction site can be optimized.

BRIEF DESCRIPTION OF THE DRAWINGS

FIG. 4 is a view depicting an example of information that is sent from an actuation count measurement function to a safety awareness level estimation function.

FIG. 6 is a view depicting an example of contents that are delivered by a delivery function.

MODE FOR CARRYING OUT THE INVENTION

Figure 1:
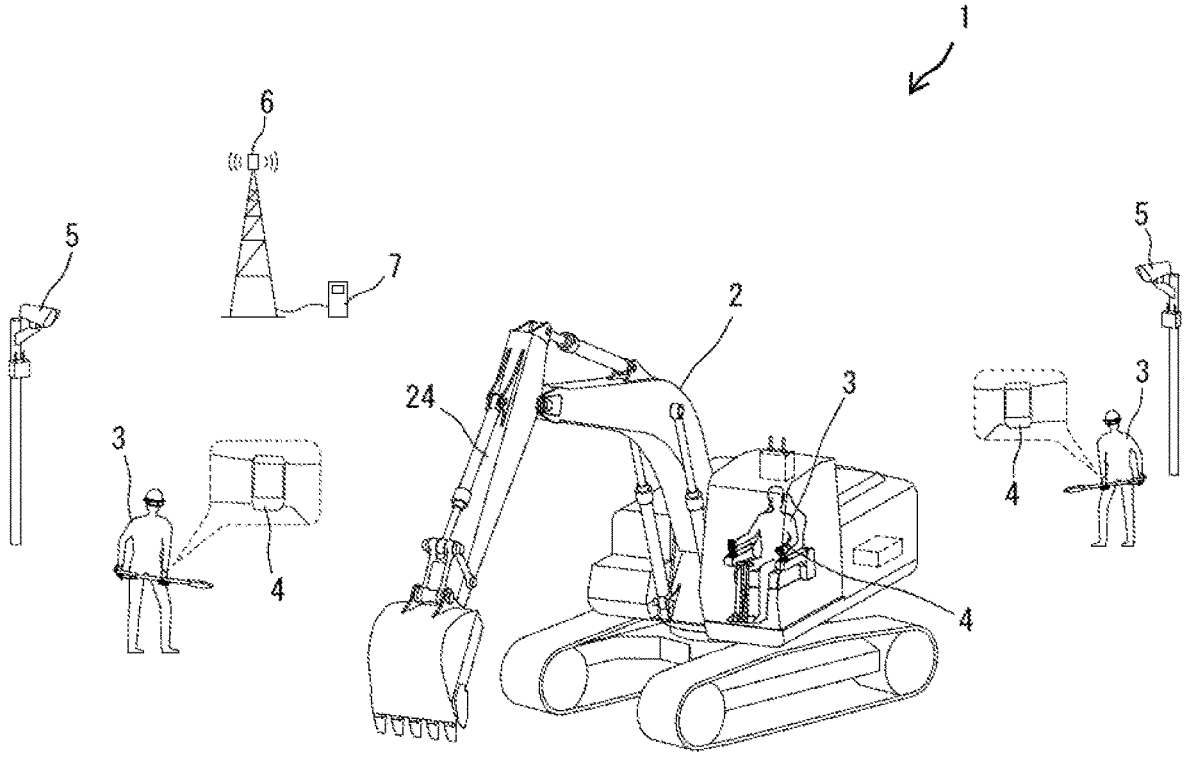
FIG. 1 is an overall view of a construction assistance system according to an embodiment of the present invention.

In the following, an embodiment of the present invention is described with reference to the drawings and the like. The following description gives a specific example of contents of the present invention, and the present invention is not restricted to the description and various alterations and modifications by those skilled in the art are possible without departing from the scope of the technical idea disclosed in the present specification. Further, in all figures used for explanation of the present invention, elements having the same function are denoted by a like reference character, and overlapping description is sometimes omitted.

FIG. 1 is an overall view of a construction assistance system 1 according to the present embodiment. The construction assistance system 1 is configured from a work machine 2, a wearable device 4 that is worn by a worker 3, an environmentally installed sensor 5, a communication facility 6, a server 7, a receiving device 8, and the like.

The work machine 2 may include any machine that performs a work, such as a construction machine or a transportation vehicle that operates at a construction site. The work machine 2 has communication equipment 23 and a controller 21 and includes a function that can be controlled to act automatically or semi-automatically by the controller 21. It is to be noted that, in the present embodiment, a hydraulic excavator is taken and depicted as an example of the work machine 2.

Each worker 3 is a person who performs a work at a construction site, and operates the work machine 2, assists a work of the work machine 2, or performs a work at a construction site irrespective of the work machine 2.

The wearable device 4 is a device that is worn by the worker 3 and includes a controller 41, communication equipment 45, an output HMI (Human Machine Interface) 44 such as a speaker or a monitor, and an input HMI 43 such as a touch panel or a button. In the present embodiment, a wearable device of a wrist watch type is taken and depicted as an example of the wearable device 4, but it may otherwise be of a glasses type or of other type.

The environmentally installed sensor 5 is installed at a construction site, and includes a camera, a laser sensor, a temperature sensor, a humidity sensor, and the like for acquiring environment information. Further, the environmentally installed sensor 5 includes communication equipment 53, similarly to the work machine 2 and the wearable device 4. The environmentally installed sensor 5 may be installed fixedly at the site or may be disposed simply and easily such that the location thereof can be changed easily. The communication facility 6 is a facility that makes it possible to connect apparatuses and devices in the construction site to the same network, and is configured from an access point and the like of a wireless LAN (Local Area Network). The server 7 is a computer connected to a communication network 61 of the communication facility 6. The receiving device 8 is a device (a computer or a FAX) capable of receiving information delivered from the server 7 through the communication network 61 and other communication means. The receiving device 8 is provided, for example, at a work site at which a construction manager or a safety supervisor is present or in an office or the like spaced away from the work site.

The work machine 2, the wearable device 4, and the environmentally installed sensor 5 can be connected to the communication network 61 provided by the communication facility 6 via the respective pieces of communication equipment included in each of them, and can transmit information by communication to and from the server 7 connected to the same network.

Figure 2:
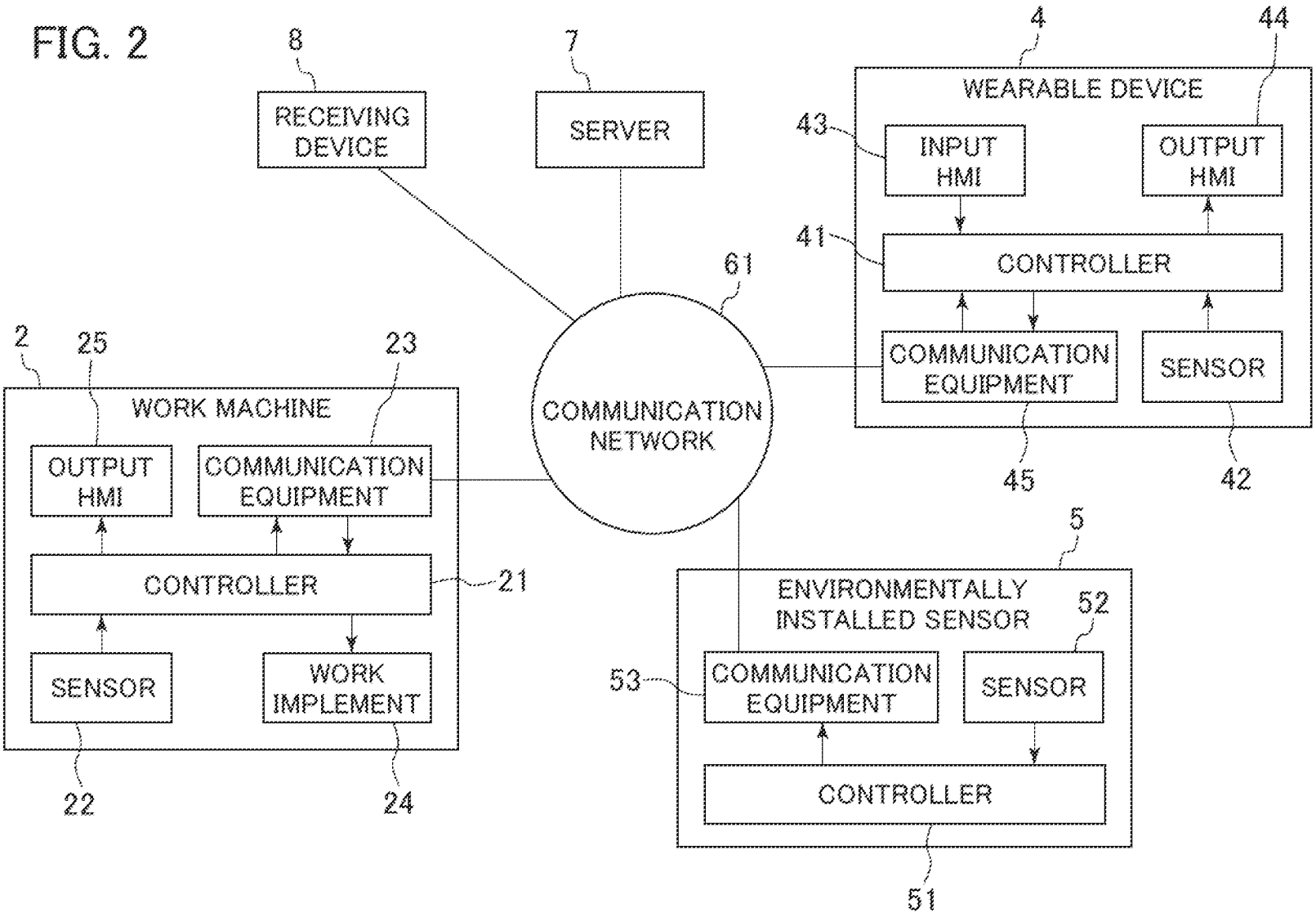
FIG. 2 is a block diagram of the construction assistance system according to the embodiment of the present invention.

FIG. 2 is a block diagram of the construction assistance system 1. The work machine 2 has a work implement 24 (for example, in the case of a hydraulic excavator, a front mechanism configured from a boom, an arm, a bucket, and the like) that performs various type of works, and the work implement 24 is controlled by the controller 21. The controller 21 further controls a safety construction assistance function and counts the actuation count of the safety construction assistance function. The safety construction assistance function is a function that senses, for example, the position of a worker 3 around the machine and slows down or stops the action of the machine if an entry of the worker 3 into a predetermined range is sensed, and that encourages the worker 3 to perform a safe behavior by issuing a warning to the worker 3 by a sound, a display, or the like or notifying the worker 3 of the state of the machine. Further, the safety construction assistance function basically is a function that senses a high-risk behavior of the worker 3 and is automatically actuated to contribute to decrease in the risk of an accident.

The work machine 2 further includes a sensor 22 that measures the position of the work machine 2 itself by a GPS (Global Positioning System) or the like and acquires the position, identification information, and the like of workers 3 around the work machine 2, an output HMI (Human Machine Interface) 25 for informing the workers 3 around the work machine 2 of a state of the machine or issuing a warning to the workers 3, such as a buzzer, a speaker, a lamp, an LED (Light Emitting Diode), a display and the like, the communication equipment 23 for communicating an actuation count of the safety construction assistance function executed in the work machine 2, and the like with the outside, and the like. Information measured by the sensor 22 is passed to the controller 21. The output HMI 25 is connected to and controlled by the controller 21 to output sound, light or the like. Further, the controller 21 can transmit and receive information to and from the outside of the machine via the communication equipment 23. The communication equipment 23 is connected to the communication network 61 provided at the construction site by the communication facility 6.

The wearable device 4 includes the input HMI 43 configured from a touch panel, a button, a switch, and the like, the output HMI 44 configured from a monitor, a speaker, a vibration device, and the like, the controller 41 that controls the HMIs and stores identification information on the workers 3, a sensor 42 configured from a GPS that measures biological information such as the heart rate and position information on the workers 3 wearing the wearable device 4, the communication equipment 45 for communicating with the outside, and the like. The position information and the like of each of the workers 3 measured by the sensor 42 are passed to the controller 41. Further, the controller 41 can transmit and receive information to and from the outside of the device via the communication equipment 45. The communication equipment 45 is connected to the communication network 61. The controller 41 further controls the safety construction assistance function that issues a warning to the workers 3 from the output HMI 44, for example, and counts the actuation count of the safety construction assistance function.

The environmentally installed sensor 5 includes a sensor 52 that measures the position, identification information, and the like of a mobile body therearound, such as a camera or a laser sensor, a controller 51 that receives measurement information on the sensor 52 passed thereto and performs such processing as to convert the measurement information into a physical value or other information, the communication equipment 53 connected to the communication network 61 for allowing the controller 51 to perform transmission and reception of information to and from the outside, and the like.

The server 7 is connected by wired or wireless connection to the communication network 61 such that it can acquire information on the work machine 2, the wearable device 4, the environmentally installed sensor 5, and the like, which are connected to the same network and transmit information on the inside thereof.

Each of the work machine 2, the wearable device 4, and the environmentally installed sensor 5 may not necessarily be provided solely at a construction site, and the count of such work machines 2, wearable devices 4, or environmentally installed sensors 5 may be or may not be a plural count. Further, the position and the identification information on each of the workers 3, an actuation count of the safety construction assistance function, and the like may be acquired from any one of the work machine 2, the wearable device 4, and the environmentally installed sensor 5.

Figure 3:
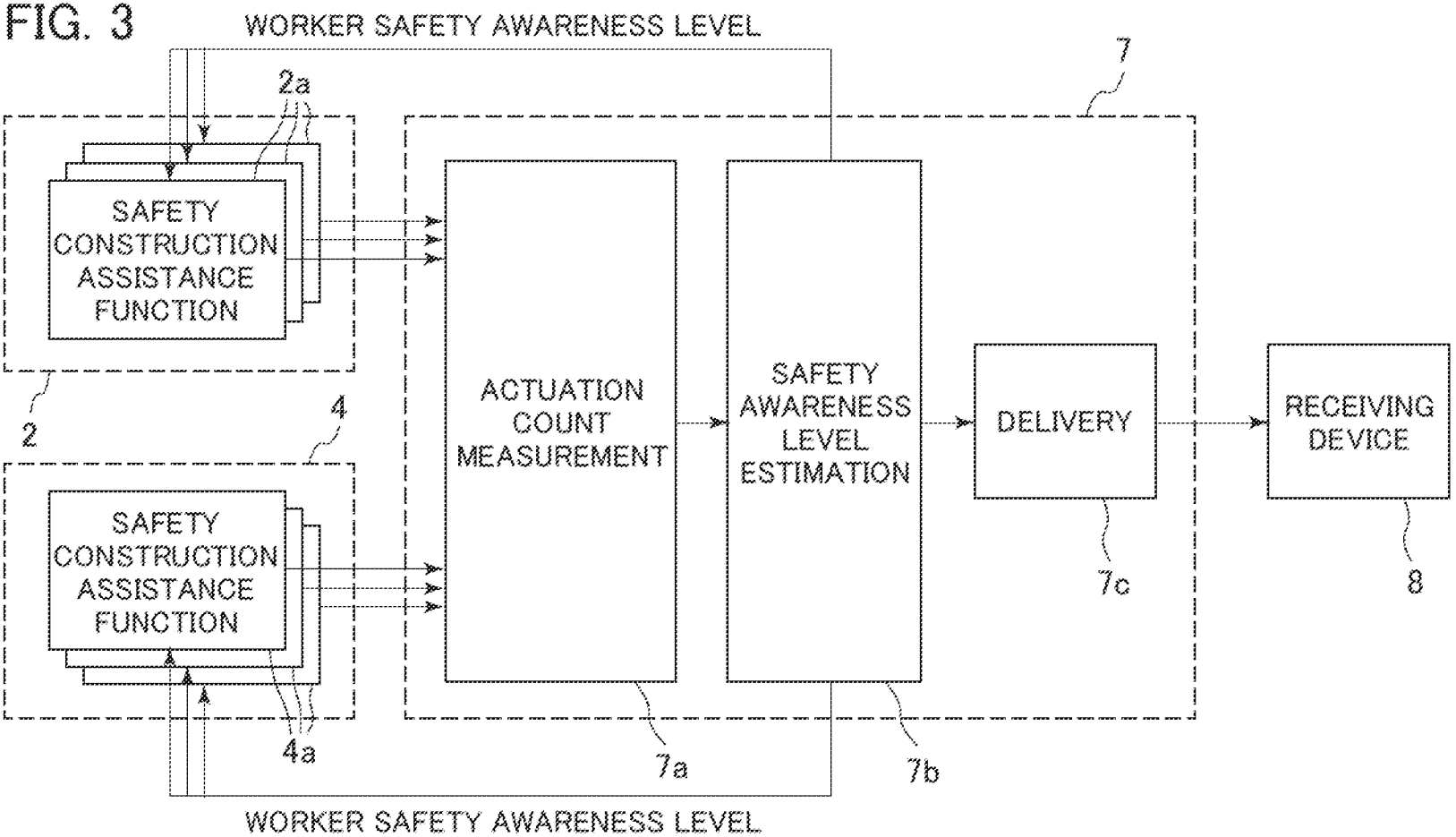
FIG. 3 is a functional block diagram of the construction assistance system according to the embodiment of the present invention.

FIG. 3 is a functional block diagram of the construction assistance system 1. The construction assistance system 1 has, as main functions thereof, a safety construction assistance function 2*a* that acts in the work machine 2, a safety construction assistance function 4*a* that acts in the wearable device 4, and an actuation count measurement function 7*a*, a safety awareness level estimation function 7*b*, and a delivery function 7*c* that all act in the server 7.

The safety construction assistance function 2*a* that acts in the work machine 2 is a function of sensing the position of each of the workers 3 around the work machine 2 and automatically slowing down or stopping, when a worker 3 comes close to the work machine 2, traveling or swinging of the work machine 2 itself or an action of the work implement 24 or the like against an operation of the operator to prevent such an accident that the worker 3 is smashed by, caught in, or run over by the work machine 2 or to reduce damage attributable to such an accident. In addition, the safety construction assistance function 2*a* is a function of sensing the position of each of the workers 3 around the work machine 2 and warning, when a worker 3 comes close to the work machine 2, the worker 3 that he/she comes too close to the work machine 2 by causing the output HMI 25 to output sound or light or display characters or a picture to call an attention to the worker 3 or causing the worker 3 to become aware of the presence of the work machine 2, to thereby prevent an accident or reduce damage attributable to an accident. An actuation state of the safety construction assistance function 2*a* (an execution state of slowing down or stopping of the action, an execution state of warning, or identification information on the target worker 3) is sent to the actuation count measurement function 7*a* of the server 7 through the communication network 61. Also, there is a case in which the safety construction assistance function 2*a* is configured from a plurality of safety construction assistance functions.

The safety construction assistance function 4*a* that acts in the wearable device 4 is a function of comparing the position of the work machine 2 acquired from the work machine 2 through the communication network 61 with the position of the wearable device 4, and when the distance between the work machine 2 and the wearable device 4 approaches a certain fixed distance, calling an attention to the workers 3 by warning the worker 3 that he/she comes too close to the work machine 2 by causing the output HMI 44 to output sound or vibration, or display characters or a picture, or the like, or causing the worker 3 to become aware of the presence of the work machine 2, to thereby prevent an accident or to reduce damage attributable to an accident. An actuation state of the safety construction assistance function 4*a* (an execution state of warning or worker identification information on the warning target person) is sent to the actuation count measurement function 7*a* of the server 7 through the communication network 61. Also, there is a case in which the safety construction assistance function 4*a* is configured from a plurality of safety construction assistance functions.

The actuation count measurement function 7*a* that acts in the server 7 is a function of receiving an actuation state of the safety construction assistance function sent from the safety construction assistance function 2*a* or 4*a* and counting an actuation count of the safety construction assistance function for each worker. The information on the actuation state of the safety construction assistance function includes which function has been actuated targeting which worker 3. The actuation count measurement function 7*a* counts how many times each worker 3 at a construction site has actuated which safety construction assistance function within a certain measurement span, and transmits information on the count to the safety awareness level estimation function 7*b*. It is to be noted that, although the measurement span can freely be set to several hours, one day, one week or the like by the construction manager, it is favorable that the measurement span be set short if it is supposed that the safety awareness level of the worker 3 at the site is low and the measurement span be set long if it is supposed that the safety awareness level is high. When the current measurement span comes to an end and a next measurement span is started, all counts are reset to zero.

FIG. 4 depicts an example of information that is sent from the actuation count measurement function 7*a* to the safety awareness level estimation function 7*b*. In this example, a case is depicted in which the number of workers 3 who work at the site is four (workers A to D) and the number of safety construction assistance functions that act in the construction assistance system at the site is four (functions A to D). Information on how many times which worker 3 has actuated which safety construction assistance function in the current measurement span is sent to the safety awareness level estimation function 7*b*.

Referring to FIG. 4, the function A is one of the safety construction assistance functions 2*a* implemented in the controller 21 of the work machine 2 and is a function of automatically stopping the action of the work machine 2 when a worker 3 comes close to the work machine 2 within a distance of 10 meters. The function B is one of the safety construction assistance functions 2*a* implemented in the controller 21 of the work machine 2 and is a function of automatically slowing down the action of the work machine 2 to 50% of the maximum speed, when a worker 3 comes close to the work machine 2 within a distance equal to or longer than 10 meters but equal to or shorter than 15 meters. X of "slowing down by X % of the maximum speed" here is a control parameter for the safety construction assistance function 2*a* and can be changed according to the safety awareness level of the worker 3.

The function C is one of the safety construction assistance functions 4*a* implemented in the controller 41 of the wearable device 4 and is a function of causing the wearable device 4 to automatically issue an alert to the wearer by vibration and sound (high sound volume), when a worker 3 (wearer) who wears the wearable device 4 comes close to the work machine 2 to a distance within 12 meters. The function D is one of the safety construction assistance functions 4*a* implemented in the controller 41 of the wearable device 4 and is a function of causing the wearable device 4 to automatically issue an alert to the wearer by vibration and sound (low sound volume), when a wearer of the wearable device 4 comes close to the work machine 2 to a distance equal to or longer than 12 meters but equal to or shorter than 17 meters. The sound volume or the magnitude of vibration of the wearable device 4 is a control parameter for the safety construction assistance function 4*a* and can be changed according to a safety awareness level of the worker 3.

Figure 5:
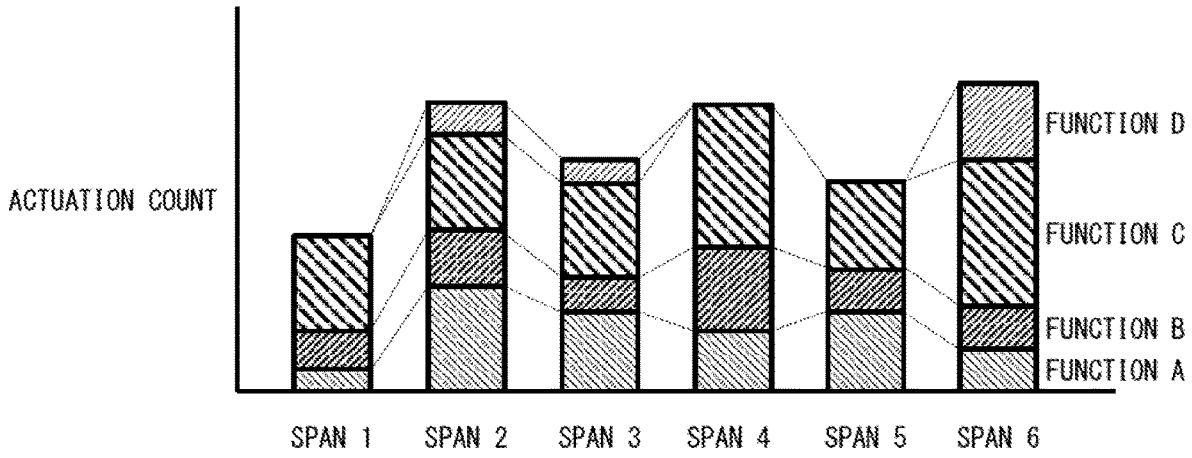
FIG. 5 is a diagram depicting an example of actuation count information on a certain worker, which is stored in the safety awareness level estimation function.

The safety awareness level estimation function 7*b* that acts in the server 7 is a function of storing the actuation count for each worker of the safety construction assistance function sent thereto from the actuation count measurement function 7*a* as well as measurement spans in the past and estimating the safety awareness level of the worker 3 from the actuation count of each function including those in the past. FIG. 5 depicts an example of actuation count information on a certain worker 3, which is stored in the safety awareness level estimation function 7*b*. Illustrated here is a case in which the number of safety construction assistance functions that act in the construction assistance system at the site is four (functions A to D), and how many times which safety construction assistance function has been rendered active in each measurement span by the target worker is stored and lined up in the order of time sequence of the measurement spans. The safety awareness level estimation function 7*b* estimates the safe awareness level of a worker 3 using the information. Although various methods are available as the estimation method of the safety awareness level, the simplest method uses a sum value of the actuation counts of the functions and can be calculated, for example, by the following expression.

$$L_i = \frac{1}{\sum_{s=a}^{b} \sum_{f=1}^{N_f} C_i^{s,f} + 1} \quad \text{[Expression 1]}$$

In the expression above, $L_i$ represents a safety awareness level estimation value of the ith worker 3; $C_i^{s,f}$ represents an actuation count of the fth safety construction assistance function in the sth measurement span of the ith worker 3; $N_f$ represents the total number of safety construction assistance functions and a and b individually represent numbers of the measurement spans, and an inverse number of a value obtained by adding 1 to the sum value of all actuation counts of the worker 3 in the ath to bth measurement spans is defined as the safety awareness level. If this expression is used, then the safety awareness level of the worker 3 whose actuation count is zero is 1, and as the actuation count increases, the safety awareness level approaches zero. The safety awareness level is a numerical value when the degree of care about the safety of the worker 3 is quantified and assumes a value, for example, from 0 to 1, and if it is defined that 1 represents a state in which the safety awareness is highest and 0 represents another state in which the safety awareness is lowest, then according to the expression above, as the safety awareness level of the worker 3 becomes lower, the frequency of activation of the safety construction assistance function becomes higher. In short, the worker 3 who comes close to the work machine 2 carelessly and causes the safety construction assistance function to operate is estimated that its safety awareness level is low.

Various functions are available as the safety construction assistance function, and also conditions in which they are actuated differ from each other. It can be considered that a safety construction assistance function that is actuated in a state in which the risk is higher (for example, in a state in which the worker 3 comes close to a position at less than one meter to the work machine) is lower in weight to the safety awareness level in one actuation count than a safety construction assistance function that is actuated in a state in which the risk is lower (for example, in a state in which the worker 3 comes close to a position at one meter or more but at less than five meters to the work machine). Therefore, as the estimation method of a safety awareness level, for example, a calculation method by the following expression is also applicable.

$$L_i = \frac{1}{\sum_{s=a}^{b} \sum_{f=1}^{N_f} \omega_f C_i^{s,f} + 1} \quad \text{[Expression 2]}$$

In the expression above, $\omega_f$ represents the weight of the fth safety construction assistance function. The weight $\omega_f$ is set for the height (emergency) of the risk of the actuation condition to each safety construction assistance function, and the sum total of the actuation counts with the weight taken into consideration is used in safety awareness level estimation. In the case of the functions A to D described hereinabove with reference to FIG. 4, since the emergency increases in the order of the functions A>C>B>D, also the weight $\omega_f$ is set higher in the order of the functions A>C>B>D. If this expression is used, then estimation of a safety awareness level of a higher degree of accuracy is possible in comparison with that when the weight $\omega_f$ is not used.

The safety awareness level of each of the workers 3 estimated by the safety awareness level estimation function 7*b* is fed back in association with the identification information of each of the workers 3 to the safety construction assistance functions 2*a* and 4*a* through the communication network 61. Consequently, the safety construction assistance functions 2*a* and 4*a* can execute such an action as to optimize the safety and the productivity by appropriately selecting an action according to the safety awareness level of the target person. For example, in the case of the safety construction assistance function that senses the worker 3 approaching the work machine 2 and slows down the action of the work machine 2, when the safety awareness level of the worker 3 of the target is high, the degree of the slowdown is moderated within a range within which the safety of the worker 3 having the high safety awareness level can be ensured, so that the productivity is not lowered. On the other hand, when the safety awareness level of the worker 3 of the target is low, the degree of the slowdown is increased within a range within which the safety of the worker 3 of the low safety awareness level can be ensured, so that the safety is increased even if the productivity is lowered. By increasing the productivity as far as possible while the necessary safety is maintained according to the safety awareness level of the worker 3 of the target, the safety and the productivity are optimized.

The delivery function 7*c* that acts in the server 7 is a function of receiving the safety awareness level of each of the workers 3 estimated by the safety awareness level estimation function 7*b* and delivering the safety awareness level of each of the workers 3 at the construction site in the form of a table, a report, or the like to the receiving device 8. By this function, the construction manager or the safety supervisor can periodically receive the safety awareness level of each of the workers 3 at the site via the receiving device 8 and simply find out a worker 3 whose safety awareness level is low. An attempt to improve the safety awareness level is performed to any worker 3 whose safety awareness level is low by performing safety education again, for example, and by increasing the safety awareness level at the entire site thereby, the safety and the productivity at the construction site are optimized, and it becomes possible to carry out construction that is safe and high in productivity.

Figure 7:
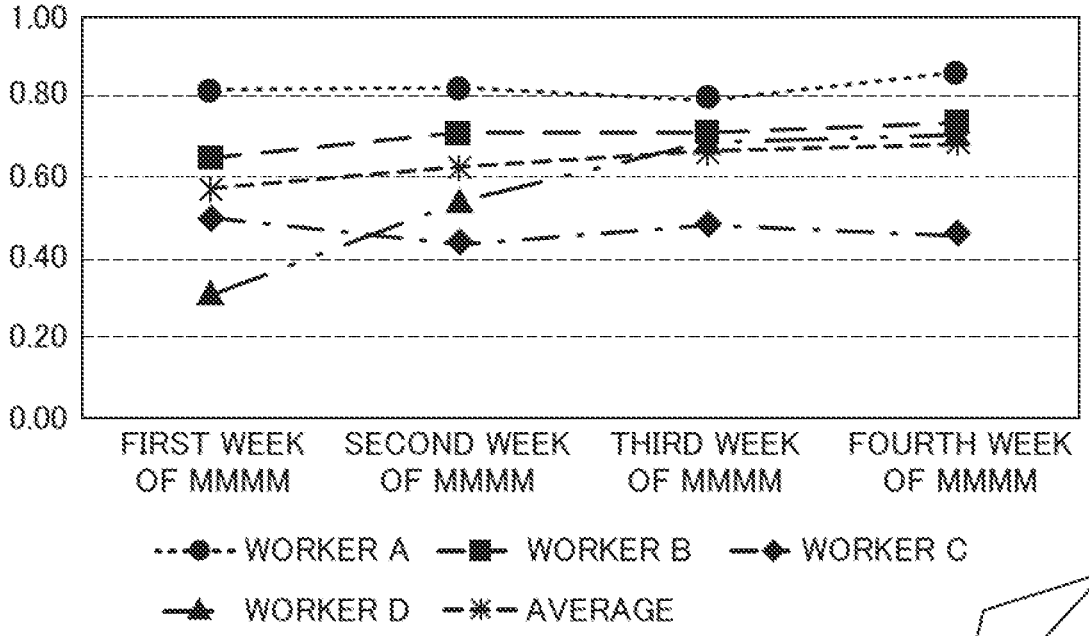
FIG. 7 is a view depicting another example of contents that are delivered by the delivery function.

The delivery function 7*c* delivers a safety awareness level estimation result to the receiving device 8, for example, after a work for one day comes to an end or in a span of one week or the like. The delivery may be performed, for example, in the form of a facsimile or an electronic mail, or may be performed in a form in which it is uploaded to a web page. Although contents of the delivery may include safety awareness level estimation value of each of the workers 3, it is better if estimation values in the past are posted in addition to the latest estimation values such that the transition of the safety awareness level is presented in a manner easy to understand. FIGS. 6 and 7 depict examples of contents delivered by the delivery function 7*c*, and FIG. 6 depicts an example in which results in the latest week and the three weeks in the past of the safety awareness level estimation values estimated in a span for every one week are presented in the form of a table, while FIG. 7 depicts an example in which such results are presented in the form of a report in which a display of a line graph is added in addition to contents similar to those in FIG. 6. Such information as just described is periodically sent to the construction manager, the safety supervisor, or the like by the delivery function 7*c*, so that it becomes helpful to make a plan for appropriate work distribution, disposition, or re-education for the workers 3 at the site according to the safety awareness level of each of the workers 3 or is helpful to make a plan for changing a safety measure to be used at the site according to the safety awareness level of the overall site. Further, in the example depicted in FIG. 7, in addition to the safety awareness levels of the individual workers A to D, an average of the safety awareness levels of the workers A to D is also outputted. Consequently, it becomes possible to grasp the overall safety awareness level of a plurality of workers 3 who work at the construction site. It is to be noted that the overall safety awareness level is not limited to an average of the safety awareness levels of the workers 3 and may be a weighted average with attributes of the workers 3 (whether or not they are veterans, what kind of education the workers 3 have received, or the like) taken into account.

In the present embodiment, the construction assistance system 1 that has the safety construction assistance functions 2*a* and 4*a* that contribute to risk reduction of workers and a work machine at a construction site includes the server 7 that collects operation information on the work machine 2 deployed at the construction site and the communication network 61 that connects the work machine 2 with the server 7, and the server 7 measures actuation counts of the safety construction assistance functions 2*a* and 4*a* and calculates and outputs a safety awareness level of the workers 3 who work at the construction site on the basis of the actuation counts.

With the present embodiment configured in such a manner as described above, it is possible to grasp to which degree the worker 3 at the construction site cares about the safety (safety awareness level) during work, and by changing the control parameters for each of the safety construction assistance functions 2*a* and 4*a* according to the safety awareness level of the worker 3 who is the target of the actuation of each of the safety construction assistance functions 2*a* and 4*a*, excessive safety construction assistance can be prevented from being carried out, and the productivity of the work can be improved. Further, by presenting the safety awareness level of the worker 3 to the supervisor of the construction site, it is also possible to carry out awareness building for a worker 3 who is low in safety awareness level (showing relatively a lack of thought regarding the safety) by safety education or the like. As a result, it is possible to optimize the safety and the productivity in a work at the construction site.

Further, the server 7 measures the actuation counts of the safety construction assistance functions 2*a* and 4*a* implemented in the controllers 21 and 41 incorporated in the work machine 2 and the wearable device 4, respectively. Consequently, it is possible to issue a notification of warning to an individual worker 3 who is high in risk.

Further, when a plurality of workers 3 are present at the construction site, the server 7 calculates the safety awareness level for each of the plurality of workers 3. This makes it possible to optimize the behavior of the safety construction assistance function 2*a* or 4*a* in response to the safety awareness level of every one of the workers.

Further, when a plurality of workers 3 are present at the construction site, the server 7 calculates a safety awareness level for the entirety of the plurality of workers 3. This makes it possible to grasp the overall safety awareness level of the plurality of workers 3 who work at the construction site.

Further, the server 7 calculates the safety awareness level according to the actuation count of each of the safety construction assistance functions 2*a* and 4*a* on the basis of a relational expression such that the safety awareness level decreases according to increase in the actuation count of each of the safety construction assistance functions 2*a* and 4*a*. This makes it possible to objectively estimate the safety awareness level of each of the workers 3 who work at the construction site.

Further, the construction assistance system 1 has a plurality of safety construction assistance functions 2*a* and 4*a* having different emergencies from each other, and the server 7 measures the actuation count of each of the plurality of safety construction assistance functions 2*a* and 4*a* and calculates the product sum of the actuation counts of the plurality of safety construction assistance functions 2*a* and 4*a* and the weights $\omega_f$ according to the emergencies of the plurality of safety construction assistance functions 2*a* and 4*a* as the actuation counts of the entirety of the plurality of the safety construction assistance functions 2*a* and 4*a*. Consequently, since the degree of decrease in the safety awareness level with respect to increase in the actuation count increases as the emergency of the safety construction assistance function increases, it is possible to improve the estimation accuracy of the safety awareness level.

Further, the server 7 has a function for delivering the safety awareness level. Consequently, the construction manager and the safety supervisor can periodically receive the safety awareness level of the workers 3 at the site and simply find out a worker 3 who is low in safety awareness level. To any worker 3 whose safety awareness level is low, an attempt to improve the safety awareness level is made by performing safety education again, for example, and by increasing the safety awareness level at the entire site, the safety and the productivity at the construction site are optimized, so that it becomes possible to carry out construction that is safe and high in productivity.

Further, the controllers 21 and 41 receive the safety awareness levels outputted from the server 7 through the communication network 61 and change control parameters for the safety construction assistance functions 2*a* and 4*a* according to the safety awareness level, respectively. Since this moderates the restriction of a work by each of the safety construction assistance functions 2*a* and 4*a* according to the safety awareness level of each of the workers 3 who work at the construction site, it is possible to automatically optimize the safety and the productivity in a work at the construction site.

Although the embodiment of the present invention has been described in detail, the present invention is not limited to the embodiment described above and includes various modifications. For example, the embodiment described above has been described in detail in order to explain the present invention in a manner easy to understand and is not necessarily limited to one that includes all configurations described above.

DESCRIPTION OF REFERENCE CHARACTERS

1: Construction assistance system
2: Work machine
2*a*: Safety construction assistance function
21: Controller
22: Sensor
23: Communication equipment
24: Work implement
25: Output HMI
3: Worker
4: Wearable device
4*a*: Safety construction assistance function
41: Controller
42: Sensor
43: Input HMI
44: Output HMI
45: Communication equipment
5: Environmentally installed sensor
51: Controller
52: Sensor
53: Communication equipment
6: Communication facility
61: Communication network
7: Server
8: Receiving device

The invention claimed is:

1. A construction assistance system that has a safety construction assistance function that contributes to risk reduction in regard to a worker and a work machine at a construction site, comprising:

a server;

a controller incorporated in the work machine deployed at the construction site;

a controller incorporated in a wearable device worn by a worker who works at the construction site;

a communication network that connects the controller of the work machine, the controller of the wearable device, and the server; and a receiving device capable of receiving information delivered from the server, wherein the controller of the work machine is implemented with a safety construction assistance function that slows down or stops the action of the work machine based on the position information of the worker sensed by a sensor mounted on the work machine, the controller of the wearable device is implemented with a safety construction assistance function that warns the worker of approaching the work machine based on the position information of the work machine received from the controller of the work machine through the communication network and position information of the wearable device, the server is configured to measure an actuation count of the safety construction assistance function implemented in the controller of the work machine and the safety construction assistance function implemented in the controller of the wearable device, calculate a safety awareness level of the worker on a basis of the actuation count, and deliver the safety awareness level to the receiving device, the safety awareness level is a numerical value obtained by quantifying a degree of care about safety of the worker within a range from 0 to 1, a weight according to an emergency is set for each of the safety construction assistance function implemented in the controller of the work machine and the safety construction assistance function implemented in the controller of the wearable device, and the server is configured to calculate a product sum of actuation counts of the safety construction assistance function implemented in the controller of the work machine and the safety construction assistance function implemented in the controller of the wearable device and weights according to the emergencies of the safety construction assistance function implemented in the controller of the work machine and the safety construction assistance function implemented in the controller of the wearable device as an actuation count of the safety construction assistance function implemented in the controller of the work machine and the safety construction assistance function implemented in the controller of the wearable device.

2. The construction assistance system according to claim 1, wherein the server is configured to calculate the safety awareness level for a plurality of workers, when the plurality of the workers are present at the construction site.

3. The construction assistance system according to claim 1, wherein the server is configured to calculate the safety awareness level for an entirety of a plurality of workers, when the plurality of the workers are present at the construction site.

4. The construction assistance system according to claim 1, wherein the server is configured to calculate the safety awareness level on a basis of a relational expression such that the safety awareness level decreases according to increase in the actuation count of the safety construction assistance function implemented in the controller of the work machine and the safety construction assistance function implemented in the controller of the wearable device.

5. The construction assistance system according to claim 1, wherein the controller is configured to receive the safety awareness level outputted from the server through the communication network and change a control parameter for the safety construction assistance function according to the safety awareness level.

* * * * *